US008134435B2

(12) United States Patent
Floresta et al.

(10) Patent No.: US 8,134,435 B2
(45) Date of Patent: Mar. 13, 2012

(54) FLUX MITIGATION

(75) Inventors: John Floresta, Commack, NY (US); Nandakumar Thirunarayan, Saint James, NY (US); Fred Sommerhalter, Oyster Bay, NY (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 710 days.

(21) Appl. No.: 12/240,633

(22) Filed: Sep. 29, 2008

(65) Prior Publication Data

US 2010/0079227 A1 Apr. 1, 2010

(51) Int. Cl.
*H01F 7/00* (2006.01)
*H01F 1/00* (2006.01)
*H01H 47/00* (2006.01)

(52) U.S. Cl. ..... 335/219; 335/284; 335/285; 335/296; 335/301; 335/302; 335/306; 361/143; 361/147; 361/148

(58) Field of Classification Search ..... 335/219, 335/284, 285–296, 301–306; 361/107, 117, 361/143, 147–148, 326; 307/91, 89, 104, 307/143; 174/32, 36, 4 R, 35, 35 R
See application file for complete search history.

(56) References Cited

U.S. PATENT DOCUMENTS 3,768,054 A * 10/1973 Neugebauer ..... 335/304
4,058,782 A * 11/1977 Forster ..... 335/219
4,482,034 A * 11/1984 Baermann ..... 188/165
4,730,230 A * 3/1988 Helfrick ..... 361/151
5,126,720 A * 6/1992 Zhou et al. ..... 335/284
5,128,643 A * 7/1992 Newman ..... 335/301
5,164,696 A * 11/1992 Kotani ..... 335/216
5,365,115 A * 11/1994 Kalyon et al. ..... 307/89
5,391,929 A * 2/1995 Kalyon et al. ..... 307/91
5,787,619 A * 8/1998 Urushibata ..... 40/449
7,113,384 B2 * 9/2006 Swinbanks et al. ..... 361/143
2002/0158736 A1 * 10/2002 Gottschalk ..... 335/306
2006/0018075 A1 * 1/2006 Schultz ..... 361/143

* cited by examiner

*Primary Examiner* — Mohamad Musleh
(74) *Attorney, Agent, or Firm* — Turocy & Watson, LLP; Scott Speroff; John Miller

(57) ABSTRACT

Aspects relate to mitigation of a magnetic field produced by one or more units to be shipped such that a magnitude of magnetic field measured is maintained at or below a threshold level. A counter-flux is applied through the use of one or more magnets, magnet arrays, or a geometrical arrangement of magnet arrays. The strength of the counter-flux is varied by altering size, shape, number, polarity and/or location of the one or more magnets or magnet arrays. The one or more magnets or magnet arrays can be constructed as standard assemblies and/or customized magnet assemblies. Additionally, magnet tiles or configurations can provide a return path for stray field leakage and mitigation. Additionally or alternatively, the placement and orientation of the magnets or magnet arrays allows the flux of one or more units to be mitigated, thus, allowing more than one unit to be shipped at the same time.

15 Claims, 9 Drawing Sheets

FLUX MITIGATION

TECHNICAL FIELD

The following description relates generally to magnetic flux, and in particular, but not exclusively, relates to mitigating remnant leakage and stray field component values.

BACKGROUND

In today's global economy, transportation of products, units, or goods is a concern for manufactures, suppliers, and others. Many products are shipped internationally, which requires either ocean voyage or air transportation. The weight of the product, the urgency of delivery of the product (e.g., hours or days verses weeks or months), as well as other concerns can dictate the shipping method.

Regulations related to commodities have been implemented especially where those commodities are considered dangerous goods. The definition of dangerous goods are commodities that, when transported, create at least some amount of danger to people, animals, the environment, and/or the carrier of those goods.

Some products deemed dangerous goods might be available for shipment based on certain circumstances. For example, current air shipment regulations state that any package that has a magnetic field greater than 5.25 milli Gauss at a distance of fifteen feet from the surface of the package anywhere along the 360° cannot be shipped by air. However, the product can be shipped by air if the product is packaged to be below 5.25 milli Gauss. If the magnetic field is below 5.25 milli Gauss at fifteen feet, but above two milli Gauss at seven feet anywhere along the 360°, the package can be shipped, but must be labeled as magnetic. If the magnetic field is below two milli Gauss at seven feet anywhere along the 360°, the product can be shipped without labeling or any other restrictions. In the situation where the package can be shipped but must be labeled as magnetic, transportation costs (e.g., air freight) are increased. For example, air freight costs can be increased four, five, or more times than the typical cost to ship a product that is not labeled as magnetic.

Machines and/or systems that utilize linear or rotary motors with permanent magnet assemblies, which are not closed volume geometries, can exhibit remnant static leakage that is below 5.25 milli Gauss at fifteen feet, but above two milli Gauss at seven feet. Thus, these machines and/or systems, to be shipped by air, are required to be labeled as magnetic. There are also a number of other products or goods that exhibit remnant static leakage above certain thresholds and thus are required to have the magnetic labeling.

The earth's magnetic field is about 500 milli Gauss and, thus, a target direct current field should be below two milli Gauss. Since each object in the universe can be considered a potential magnetic dipole, there are multiple sources of potential magnetic field generators that can hinder achievement of a low magnetic field of two milli Gauss or less.

SUMMARY

The following presents a simplified summary in order to provide a basic understanding of some aspects of the disclosed examples. This summary is not an extensive overview and is intended to neither identify key or critical elements nor delineate the scope of such aspects. Its purpose is to present some concepts in a simplified form as a prelude to the more detailed description that is presented later.

In accordance with one or more examples and corresponding disclosure thereof, various aspects are described in connection with mitigating remnant leakage and stray field component values. The disclosed aspects provide a manufacturing assembly and cost effective engineering solution to mitigate the remnant leakage and stray field component values.

In accordance with an aspect is a method for mitigating the amount of a measured flux field. The method includes choosing a magnet, an array of magnets, or a geometrical arrangement of magnet arrays to be included with a unit for shipment as a function of a measured magnetic flux field. The magnetic flux field is measured at a specified distance from the unit. The method also includes applying a counter-flux to maintain the measured magnetic flux field at or below a threshold level.

Another aspect relates to a system that mitigates the measured amount of a magnetic field. The system includes a measurement component that gathers information related to a first reading associated with a unit to be shipped. The information is an amount and a direction of a magnetic field. The system also includes a counter-flux component that recommends a magnet array for orientation around the unit to be shipped as a function of the information obtained by measurement component. The measurement component obtains a second reading after implementation of the recommendations provided by the counter-flux component.

A further aspect relates to a method for utilizing magnetic directional characteristics of a unit configuration to mitigate magnetic field vectors. The method includes identifying a polarity of a magnet field vector emitted by multiple units to be shipped due to individual stages and determining an orientation of the multiple units to be shipped to mitigate the magnetic field vector. Additionally, the method can include utilizing one or more magnet arrays, custom magnet tiles, magnetic shields, or combinations thereof.

To the accomplishment of the foregoing and related ends, one or more examples comprise the features hereinafter fully described and particularly pointed out in the claims. The following description and the annexed drawings set forth in detail certain illustrative aspects and are indicative of but a few of the various ways in which the principles of the various aspects may be employed. Other advantages and novel features will become apparent from the following detailed description when considered in conjunction with the drawings and the disclosed examples are intended to include all such aspects and their equivalents.

DETAILED DESCRIPTION

Figure 1:
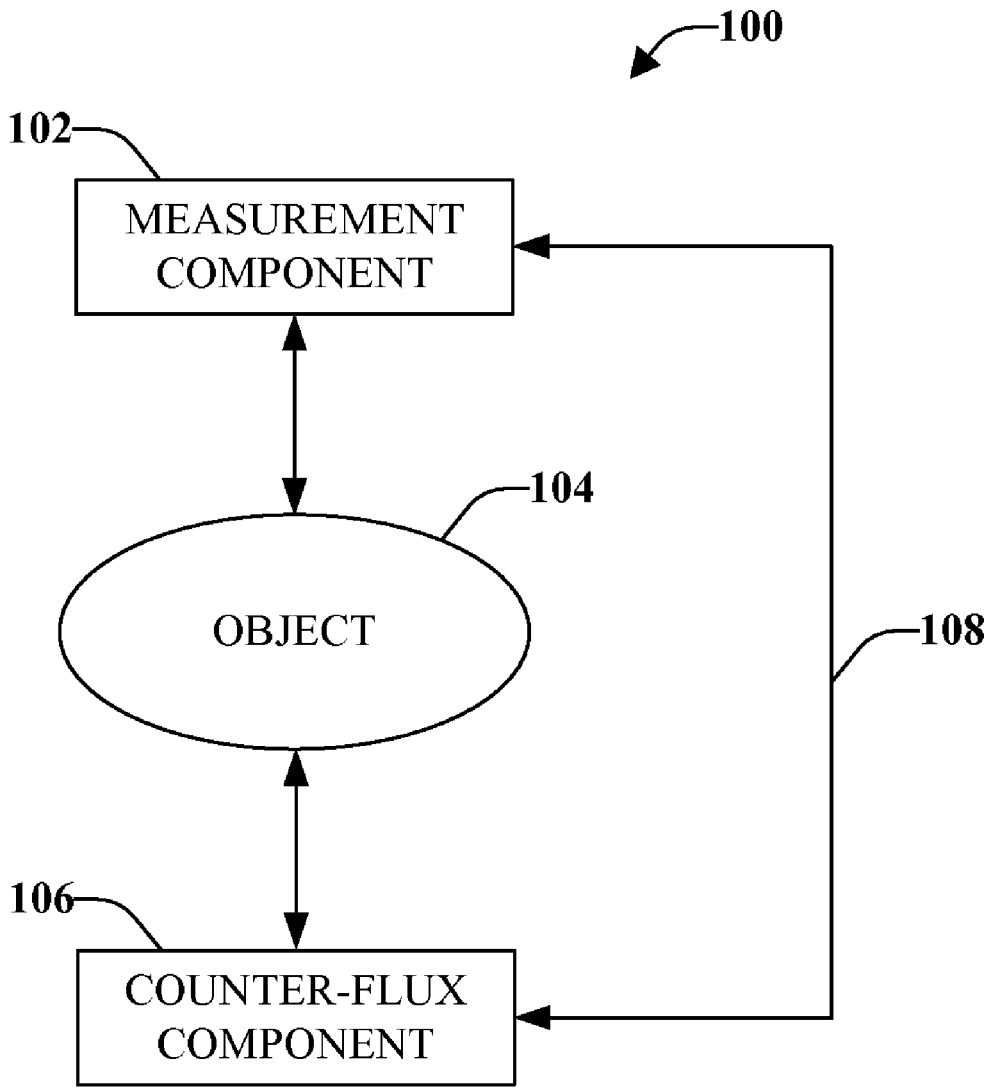
FIG. 1 illustrates a counter-flux system in accordance with one or more of the disclosed aspects.

Various aspects are now described with reference to the drawings. In the following description, for purposes of explanation, numerous specific details are set forth in order to provide a thorough understanding of one or more aspects. It may be evident, however, that the various aspects may be practiced without these specific details. In other instances, well-known structures and devices are shown in block diagram form in order to facilitate describing these aspects.

Various aspects will be presented in terms of systems that may include a number of components, modules, and the like. It is to be understood and appreciated that the various systems may include additional components, modules, etc. and/or may not include all of the components, modules, etc. discussed in connection with the figures. A combination of these approaches may also be used. The various aspects disclosed herein can be performed on electrical devices including devices that utilize touch screen display technologies and/or mouse-and-keyboard type interfaces. Examples of such devices include computers (desktop and mobile), smart phones, personal digital assistants (PDAs), industrial controller, and other electronic devices both wired and wireless.

As used in this application, the terms "component", "module", "system", and the like are intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a server and the server can be a component. One or more components may reside within a process and/or thread of execution and a component may be localized on one computer and/or distributed between two or more computers.

Methodologies that may be implemented in accordance with some of the disclosed aspects are shown and described as a series of blocks. It is to be understood and appreciated that the disclosed aspects are not limited by the number or order of blocks, as some blocks may occur in different orders and/or at substantially the same time with other blocks from what is depicted and described herein. Moreover, not all illustrated blocks may be required to implement the methodologies described herein. It is to be appreciated that the functionality associated with the blocks may be implemented by software, hardware, a combination thereof or any other suitable means (e.g. device, system, process, component, and so forth). Additionally, it should be further appreciated that the methodologies disclosed throughout this specification are capable of being stored on an article of manufacture to facilitate transporting and transferring such methodologies to various devices. Those skilled in the art will understand and appreciate that a methodology could alternatively be represented as a series of interrelated states or events, such as in a state diagram.

Reference throughout this specification to "some aspects", "an aspect", or the like, means that a particular feature, structure, or characteristic described in connection with the aspect is included in at least one aspect of the disclosed subject matter. Thus, the appearances of the phrase "in one aspect", "in an aspect", or the like, in various places throughout this specification are not necessarily all referring to the same aspect. Furthermore, the particular features, structures, or characteristics may be combined in any suitable manner in one or more aspect.

Referring initially to FIG. 1, illustrated is a counter-flux system 100 in accordance with one or more of the disclosed aspects. System 100 is configured to provide counter-flux (e.g., flux cancellation and/or flux reduction) to mitigate an amount of remnant leakage and stray field component values that are emitted by a product or unit that is to be shipped. The counter-flux applied is chosen so that the stray field component values are maintained at or below a threshold level. For example, machines, components, and/or systems that utilize permanent magnets and/or magnet assemblies can exhibit remnant static leakage magnetic fields that are above threshold limits set by shipping regulators, such as the Department of Transportation (DoT), the Federal Aviation Administration (FAA), the International Civil Automation Organization (ICAO), the International Air Traffic Association (IATA), and so on. If the amount of a magnetic field is too large, the item cannot be shipped by air. If the amount of the magnetic field is between threshold limits at a certain distance, the item can be shipped by air with appropriate labeling, which results in increased shipping costs as well as other concerns. If the amount of the magnetic field is below a minimum threshold level, the unit can be shipped without labeling and/or other restrictions.

System 100 can be utilized in a manufacturing assembly environment and can include a measurement component 102 that is configured to measure the amount of magnetic field produced by an object 104. The magnetic field can be measured at a desired distance away from the object (e.g., fifteen feet, seven feet, and so on). Magnetic fields (denoted by B) has an associated direction and strength or magnitude, commonly referred to as a magnetic vector.

The object 104 can be any item, machine, system, assembly, and so forth, for which a magnetic field measurement (e.g., horizontal or other measurement orientation) is desired. For example, the object 104 can be manufacturing equipment, machinery, components, and so forth. Although a single object 104 is illustrated, the object 104 can include multiple items that constitute a single assembly. In accordance with some aspects, the object 104 is a package or box that contains a multitude of items (e.g., linear motors, rotary motors, and so forth) that are being prepared for shipment. In accordance with this aspect, the object 104 is a multitude of the same product and/or different products for which a magnetic field measurement is to be mitigated.

In an example, the measurement component 102 can be a gaussmeter or a hall-sensing feedback device that is utilized to test packages for compliance with air shipping requirements. The measurement component 102 can be configured to measure alternating current (AC) and/or direct current (DC) magnetic fields. The gaussmeter can be a single probe meter or a multi-probe meter. Measurement of field values, such as two milli Gauss (or less), should be performed with properly calibrated instrumentation that has reliable accuracy and repeatability. Further, to measure such values an isolated environment where the contribution and effect of magnetic sources is nullified should be utilized.

The measurement component 102 can be placed at any location around the object 104 and/or can be moved to any location (e.g., manually, automatically) to capture an accurate measurement. In accordance with some aspects, multiple measurement components 102 can be utilized to obtain accurate and meaningful measurements. Multiple measurement components 102 can be useful to obtain remnant leakage and stray field component values for objects 102 whose magnetic field direction is not known. For example, a shipping company might receive items for shipment and might not have specifications or other information readily available. Thus, the shipping company should measure the magnetic leakage of the product at multiple locations.

Also included in system 100 is a counter-flux component 106 that is configured to mitigate the amount of flux associated with the object 104. The counter-flux component 106 can utilize the values gathered by measurement component 102 and determine the appropriate counter-flux to be utilized. For example, counter-flux component 106 can make a recommendation based on reducing the amount of flux emitted by the object 104 to be at or below a threshold level. The values can be directly communicated from the measurement component 102 to the counter-flux component 106 through a communication link 108, for example.

In an aspect, counter-flux component 106 can determine the amount of magnets (e.g., a single magnet, multiple magnets, an array of magnets, a geometrical arrangement of magnet arrays) that are to be placed around the object 104 to mitigate the amount of magnetic flux emitted by the object at a specific distance (as determined by measurement component 102). In accordance with some aspects, counter-flux component 106 can determine a size of one or more magnets that are to be utilized to mitigate the remnant leakage and stray field component values measured at a given distance away from the unit or object 104.

Counter-flux component 106 can also determine the proper polarity of the one or more magnets (or array). Magnetic polarity is referred to as having a north pole (at one end) and a south pole (at a second end). For example, if the polarity gathered by measurement component 102 indicates a magnetic flux in a first direction (e.g., south), counter-flux component 106 can determine that one or more magnets having a magnetic flux in a second direction (e.g., north) should be utilized to mitigate the amount of the magnetic field measured at a target distance away from the object 104.

Further, counter-flux component 106 can be configured to determine the amount of strength (e.g., energy product) of the one or more magnets. Counter-flux component 106 can also be configured to determine a location of the magnet(s)/array to offset, cancel and/or reduce the magnetic field of the object 104 to as low a value as possible.

The recommendations provided by counter-flux component 106 can be communicated to a user for manual placement of the recommended number of magnets or array of magnets, selection of magnet(s) array having a specific polarity and/or strength, and so forth. In accordance with some aspects, the selection and placement of the magnet(s) can be performed automatically through machinery, robotics, or another automated system capable of performing the selection and/or placement actions.

After application of the recommendations of counter-flux component 106 (e.g., selection of magnet(s), placement of magnet(s)) measurement component 102 can be requested to re-measure the resultant magnetic flux of the object 104. The request for a second (or subsequent) measurements can be received directly from counter-flux component through the communication link 108, which operates as a feedback loop. In accordance with some aspects, the subsequent measurement request is manually provided to the measurement component (e.g., from a user), and/or by placing the object 104 in a location where the horizontal magnetic flux will be re-measured (e.g., placed on a conveyer belt, sensing of the object by one or more sensors, and so forth).

Figure 2:
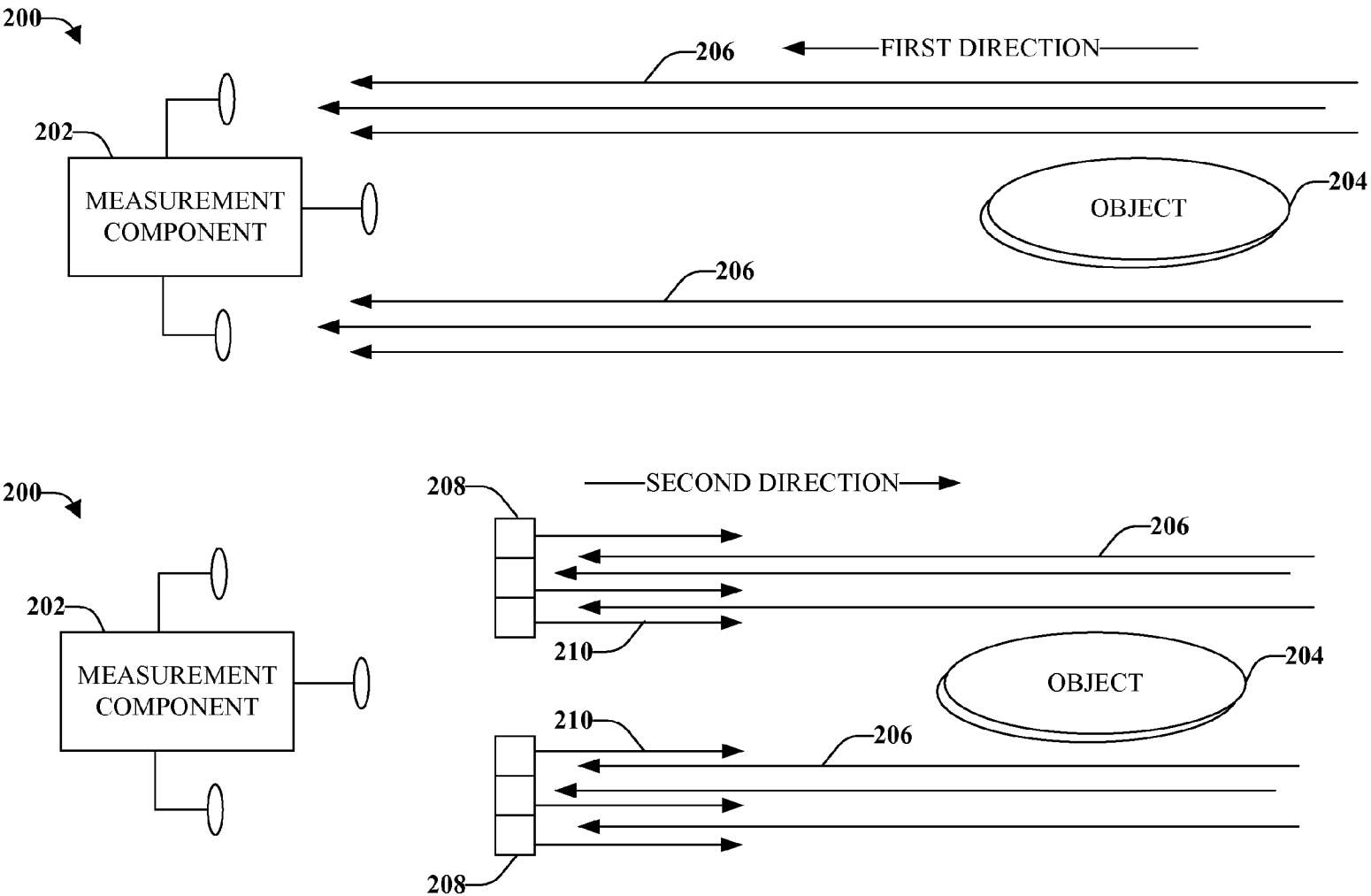
FIG. 2 illustrates a schematic representation of an example flux mitigation system in accordance with aspects disclosed herein.

FIG. 2 illustrates a schematic representation of an example flux mitigation system 200 in accordance with aspects disclosed herein. System 200 includes one or more measurement components 202. Placement of the measurement components 202 in systems that utilize more than one measurement component can be at any place around an object under test 204 (e.g., above, below, each side, and so forth). In accordance with some aspects, a single measurement component 202 is utilized and placed on a wheeled cart or other movable means that allows the measurement component 202 to be moved around the object under test 204.

The illustrated measurement component 202 has three probes, however, any other number of probes can be utilized to measure the horizontal magnetic flux of the object under test 204. The probes can be placed in a fixed position in a holder and/or in a holder that provides adjustment of a vertical height and/or horizontal location.

The measurement component 202 should be placed at the desired distance away from the object 204 to obtain the appropriate reading. For example, if regulations require the amount of remnant leakage and stray field component values to be below a threshold value at a certain distance (e.g., five feet), the measurement should be taken at five feet or less away from the object 204.

Further, the object under test 204 should be placed on a nonmetallic surface to mitigate inaccurate measurements. For example, if the object under test 204 is placed on a metallic table, the magnetic field emitted from the object might be disrupted or shunted by the metallic table, which can result in inaccurate measurements.

The object under test 204 emits a magnetic field in one or more directions. For explanation purposes, the illustrated object under test 204 emits a magnetic field in a first direction, illustrated by the arrows at 206, at the top portion of the figure. The measurement component 202 detects the direction and magnitude of the magnetic flux and a counter-flux component (not shown) can determine an appropriate amount of counter-flux (magnet(s), magnet arrays, a geometrical arrangement of magnet arrays, other components, and so on) that should be applied to mitigate the amount of remnant leakage and stray field components emitted by the object under test 204.

Based on the determination made by counter-flux component (not shown) one or more magnets, magnet arrays, or a geometrical arrangement of magnet arrays, illustrated at 208, can be placed at a location around the object to mitigate the amount of magnet flux (e.g., to cause the emitted magnetic flux to be at or below a threshold level). For example, the magnets or magnet arrays 208 can be placed on the packaging (e.g., inside a shipping container). The magnets or magnet arrays 208 can cause a counter-flux to be produced in a second direction, illustrated at 210 at the bottom of the figure.

A second measurement can be gathered by measurement component 202 to determine whether the remnant leakage and stray field component values emitted 206 by the object under test 204 (at the target distance) is at or below a threshold level. If the emitted magnetic flux 206 is at or below the threshold level, no further action is necessary. If the emitted magnetic flux 206 is still above the threshold level, additional techniques can be utilized by counter-flux component (not shown) to mitigate the amount of measured flux (e.g., additional magnets/magnet arrays, larger magnets, steel keepers, magnetic shielding, and so forth). These additional techniques will be described in further detail below.

Figure 3:
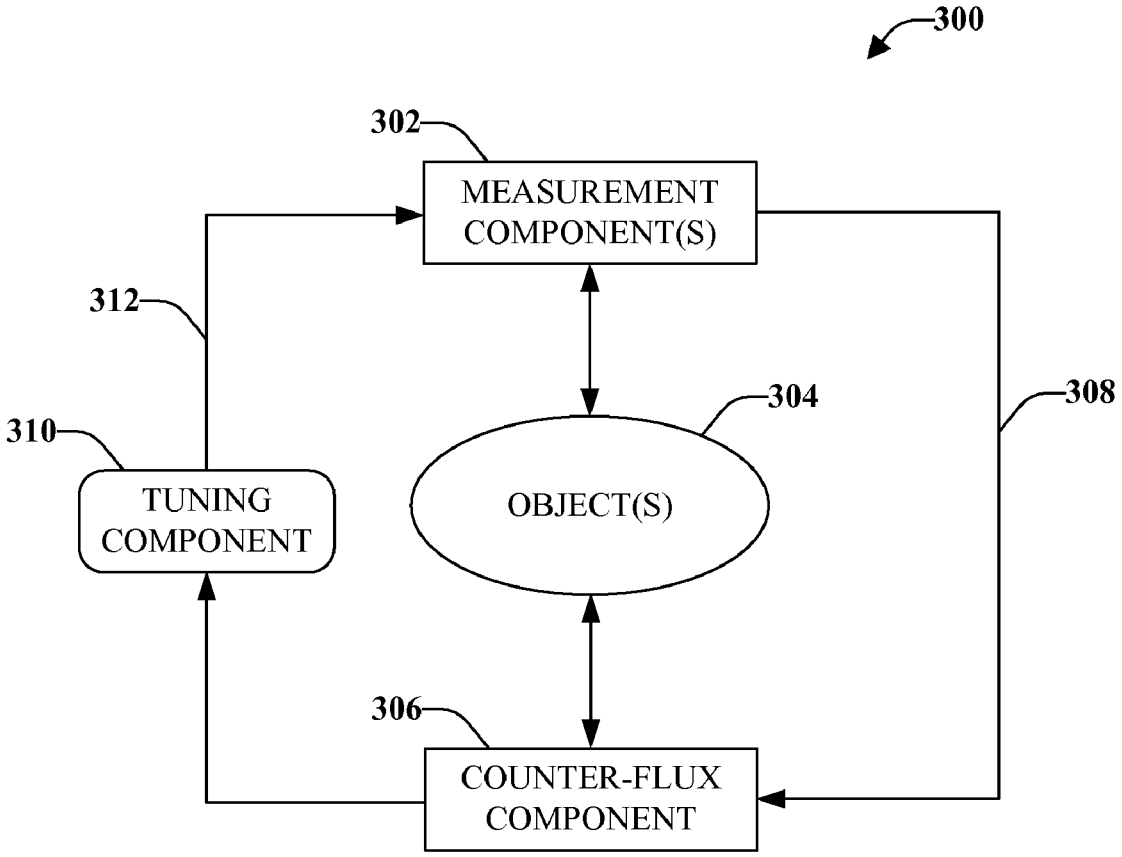
FIG. 3 illustrates a system for mitigating the remnant leakage and stray field component values of a product under test in accordance with an aspect.

FIG. 3 illustrates a system 300 for mitigating the remnant leakage and stray field component values of a product under test in accordance with an aspect. System 300 includes one or more measurement components 302 that can be utilized to measure a magnetic field value of one or more objects under test 304. A counter-flux component 306 can determine where to place individual magnets, an array of magnets, a geometrical arrangement of magnet arrays, or combinations thereof, having a proper polarity, strength (e.g., energy product), and/or location to offset, cancel, and/or reduce the measured magnetic field. The determination by counter-flux component 306 can be based, in part, on information received from measurement component 302 through a communication link 308.

Counter-flux component 306 can be configured to vary the size, number, polarity and/or location of the magnets or magnet array(s). In such a manner the magnets or magnet array(s) can be customized and manufactured to a given magnetic flux field environment. This can allow the magnets or magnet array(s) to be used on a multitude of object (or unit) configurations. In accordance with some aspects, the direction of a B-Field vector (e.g., flux density) of the magnet(s) or magnet array(s) can be orthogonal to the direction of a main field to oppose the leakage magnetic field.

In accordance with some aspects, a tuning component 310 can be included in system 300. Tuning component 310 can be utilized to vary a level of counter-flux to provide a precise means of attempting to mitigate (or "zero") the stray flux level measured at a target distance. The tuning component 310 can be included in a feedback loop 312 between the counter-flux component 306 and the measurement component 302.

For example, the information gathered by measurement component 302 can be communicated to counter-flux component 306 through communication link 308. Counter-flux component 306 can determine an appropriate magnet/magnet array and/or other items (e.g., steel keepers, shielding, and so forth) to be utilized as well as orientation of the magnet/magnet array. The counter-flux information is provided to tuning component 310, which selectively changes one or more characteristics of the magnet/magnet array and/or other items. Thus, tuning component 310 can selectively adjust the amount of counter-flux applied to account for variances between objects under test 304.

In accordance with some aspects, tuning component 310 can be a mechanical component, such as a shunting pole. According to some aspects, tuning component 310 can be electromagnetic, such as a tuning coil connected to a power source.

Additionally or alternatively, system 300 can utilize steel "keepers", which are ferromagnetic components that capture the stray flux at the magnetic emanation point. Steel keepers can be utilized for objects for which stray flux can be mitigated with the use of steel keepers separately or in conjunction with other aspects disclosed herein. The determination to utilize steel "keepers" can be made by counter-flux component 306 after a first measurement or after a subsequent measurements if one or more attempts to mitigate the remnant leakage and stray field component values is not successful.

Further, system 300 can optionally utilize magnetic shielding in conjunction with (or in lieu of) the magnet/magnet array. Magnetic shielding utilizes a high permeable material, a medium permeable material, or combination thereof to shield stray flux. In addition, the magnetic shield assemblies can consist of a multi-layered configuration of High permeability steel and Medium permeability steel with each layer separated by non-magnetic material or paramagnetic material, such as aluminum.

In accordance with some aspects, the magnet/magnet array and optionally sub-components (e.g., steel keepers, magnetic shielding, and so forth) can be constructed as standard assemblies. For example, magnets, epoxy, and optional sub-components can be utilized for use when packaging a variety of objects 304. For example, if multiple similar objects 304 are to be shipped separately, magnetic assemblies can be produced and utilized for each object, with or without capturing the remnant leakage and stray field component value measurement for each object.

In accordance with an aspect, custom magnet tiles (configurations) can be utilized to provide a return path and termination to the leakage and stray magnetic field flux lines. This can mitigate the leakage remnant field. The magnet tiles can be standard assemblies and/or customized for various sizes, shapes, footprints, and multiple magnetic field source configurations.

In accordance with some aspects, directional characteristics of the unit configuration can be utilized to mitigate (or cancel) the magnetic field vectors. Cancellation of the field can be enabled by identifying the polarity of the field direction due to the individual stages, which can be identified by one or more measurement components 302.

According to some aspects, multiple units or objects 304 can be shipped at substantially the same time while mitigating the total amount of remnant leakage and stray field component values measured. In accordance with this aspect, a proper orientation of the objects 304 (or units) can enable a more effective cancellation. For example, the orientation of the units can be achieved by placing the units side-by-side, placing the units in a stacked configuration, an angular placement, and so forth. The determination of a unit configuration can be made by counter-flux component 306 or another component.

Figure 4:
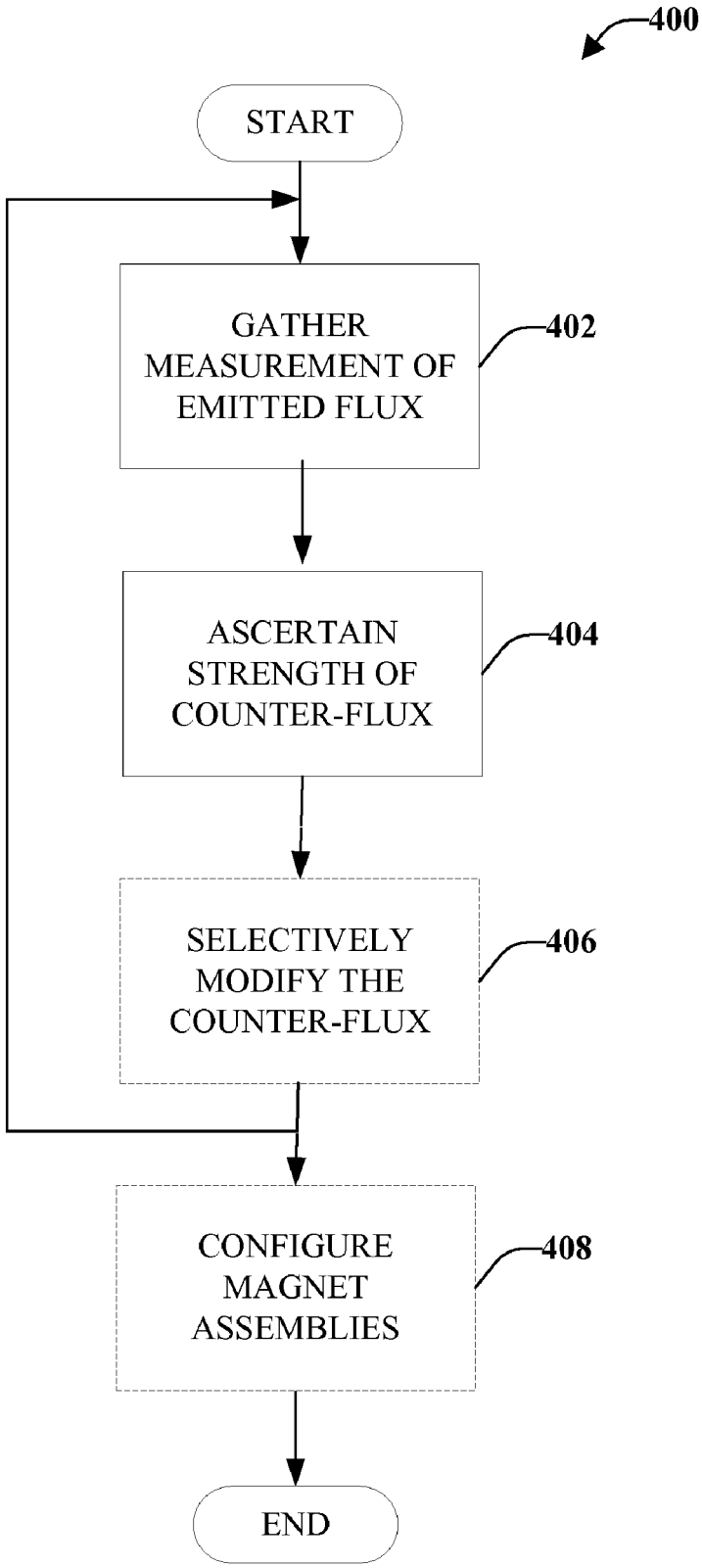
FIG. 4 illustrates a method for mitigating the amount of remnant leakage and stray field component values according to an aspect.

FIG. 4 illustrates a method 400 for mitigating the amount of remnant leakage and stray field component values according to an aspect. Method 400 provides a cost effective solution to mitigate to remnant leakage and stray field component values emitted by a product as measured at various distances from the product. The mitigation of remnant leakage and stray field component values can allow the unit to be shipped without requiring magnetic labeling and/or with appropriate labeling.

Method 400 starts, at 402, where a magnetic flux field emitted by a product is identified. The magnetic flux field can be measured through use of a gaussmeter, a hall-sensing feedback device, or another component designed to measure the magnetic field (e.g., horizontal magnetic field) of one or more objects (e.g., items, units, assemblies, machines, or combinations thereof). The measurement should be taken at an appropriate distance from the product, such as distances associated with shipping regulations. In accordance with some aspects, the measurement should be taken at a distance closer to the product than specified by shipping regulations.

At 404, a magnet, an array of magnets, a geometrical arrangement of magnet arrays, or combinations thereof, is chosen as a function of the measured magnetic flux field. The magnet/magnet array can be chosen of a function of the strength or amount of counter-flux that should be applied to counteract the emitted magnetic field. For example, based on the measurement it might be determined that a single magnet is necessary to mitigate the amount of magnetic flux measured at the appropriate distances. According to some aspects, multiple magnets or one or more magnet arrays might be necessary. Further, one or more magnets or magnet arrays might be needed at different locations around the product, depending on whether the product is emitting multiple magnetic fields in different directions.

In an optional aspect, as denoted by the dashed line at 406, the counter-flux can be altered to further mitigate the amount of magnet field flux measured at the target distance away from the unit. The altering of the counter-flux can be utilized to customize the applied counter-flux to the product under test. As illustrated, after tuning the counter-flux, at 406, method 400 can return to 402 where a second (or subsequent) measurement is taken to determine if the modifications mitigate the measured remnant leakage and stray field component values to at or below a threshold level. It is to be understood that this act can be recursive such that any number of modification and measurements can be taken. For example, if the second measurement indicates that the remnant leakage and stray field component values are above the threshold level, further counter-flux actions can be taken at 404 and/or 406. Thereafter a third (or more) measurements and counter-flux actions can be taken as needed.

Additionally or alternatively, at 408, the magnet/magnet arrays can be manufactured as standard assemblies and/or customized assemblies. For example, magnets, epoxy (or other types of adhesive) can be constructed as standard assemblies for use with numerous similar products (e.g., same units are to be shipped). In accordance with some aspects, the standard assemblies and/or customized assemblies can include steel keepers. According to some aspects, magnetic shielding is included in the standard and/or customized assemblies. Further, both steel keepers and magnetic shielding can be included in a standard and/or customized assemblies.

Figure 5:
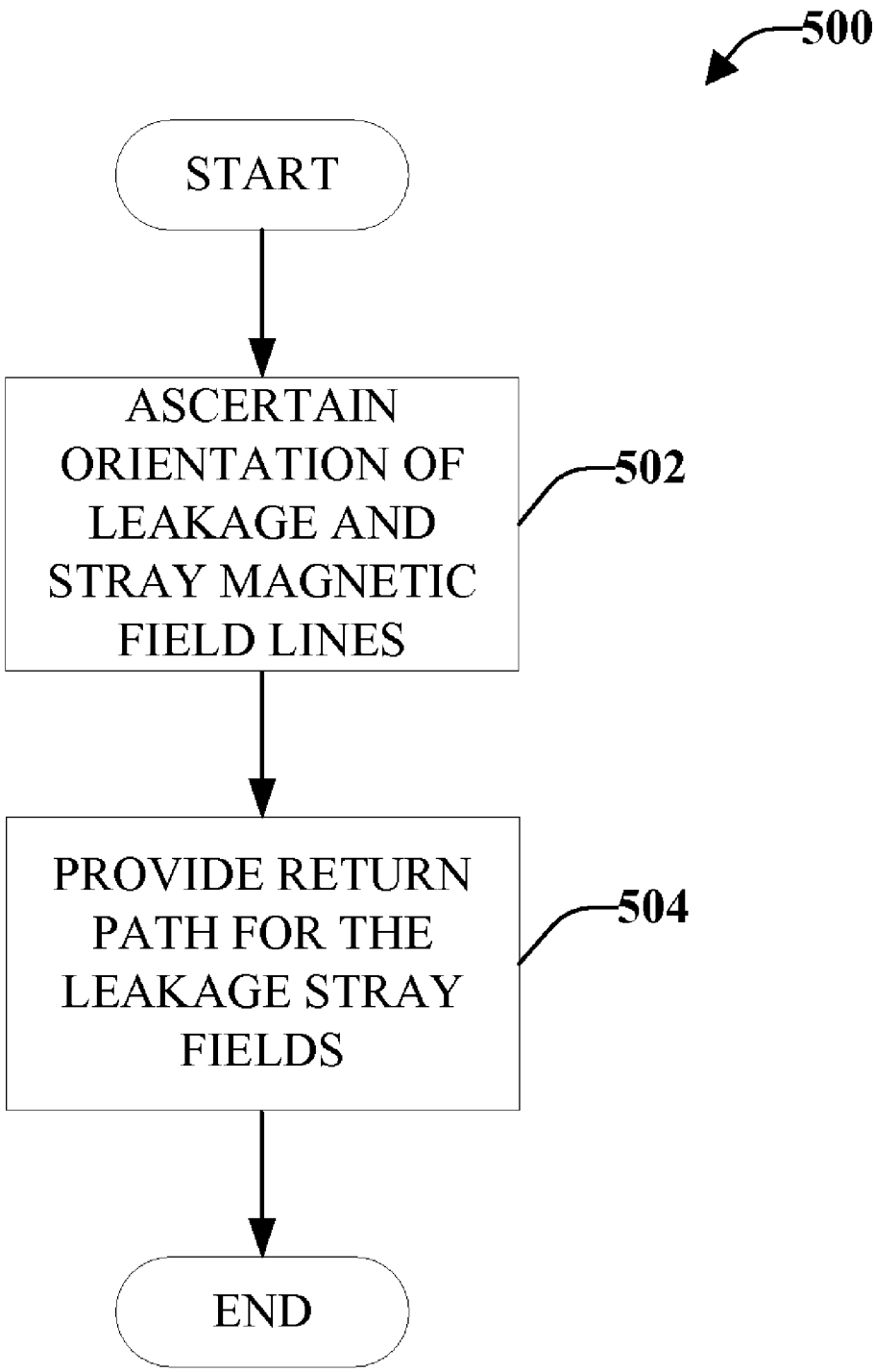
FIG. 5 illustrates a method for mitigating a measured magnetic field emitted by a product in accordance with one or more aspects.

With reference now to FIG. 5, illustrated is a method 500 for mitigating a measured magnetic field emitted by a product in accordance with one or more aspects. Method 500 utilizes custom magnet tiles or configurations to provide a return path and termination to the leakage and stray magnetic field flux lines.

Method 500 starts, at 502, when the orientation of leakage and stray magnetic field flux lines is ascertained. Based on the identification of the orientation of leakage and stray magnetic field flux lines, a return path for the leakage stray fields is provided, at 504. The return path can be enabled by the use of one or more magnets or magnet arrays, which can be manufactured as standard and/or customized assemblies. In accordance with some aspects, the magnets or magnet arrays for providing the return path can be customized for various sizes, shapes, footprints, and/or a multiple of magnetic field source configurations.

Figure 6:
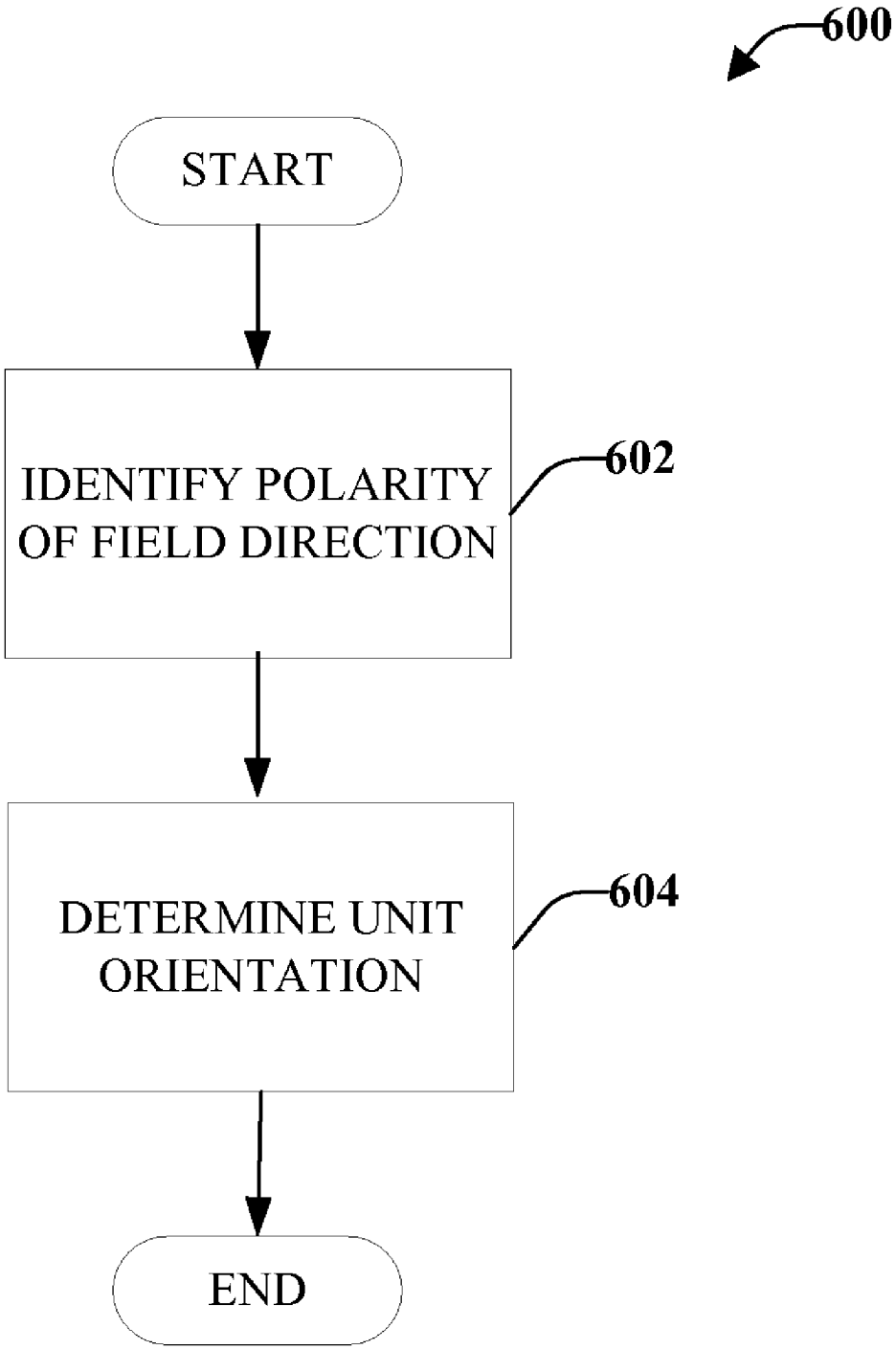
FIG. 6 illustrates a method for orientation of multiple units in accordance with one or more aspects.

FIG. 6 illustrates a method 600 for orientation of multiple units in accordance with one or more aspects. Method 600 utilizes the directional characteristics of a unit configuration to mitigate or attempt to cancel or magnetic field vectors. In such a manner, method 600 can enable multiple units to be shipped at the same time.

At 602, the polarity of a field direction due to individual stages is identified. Based on the identification of the field direction polarity, the orientation of the unit is determined, at 604, in order to provide a more effective cancellation of the magnetic field. For example, the units can be placed side-by-side, in a stacked configuration, in an angular placement, and so forth.

Figure 7:
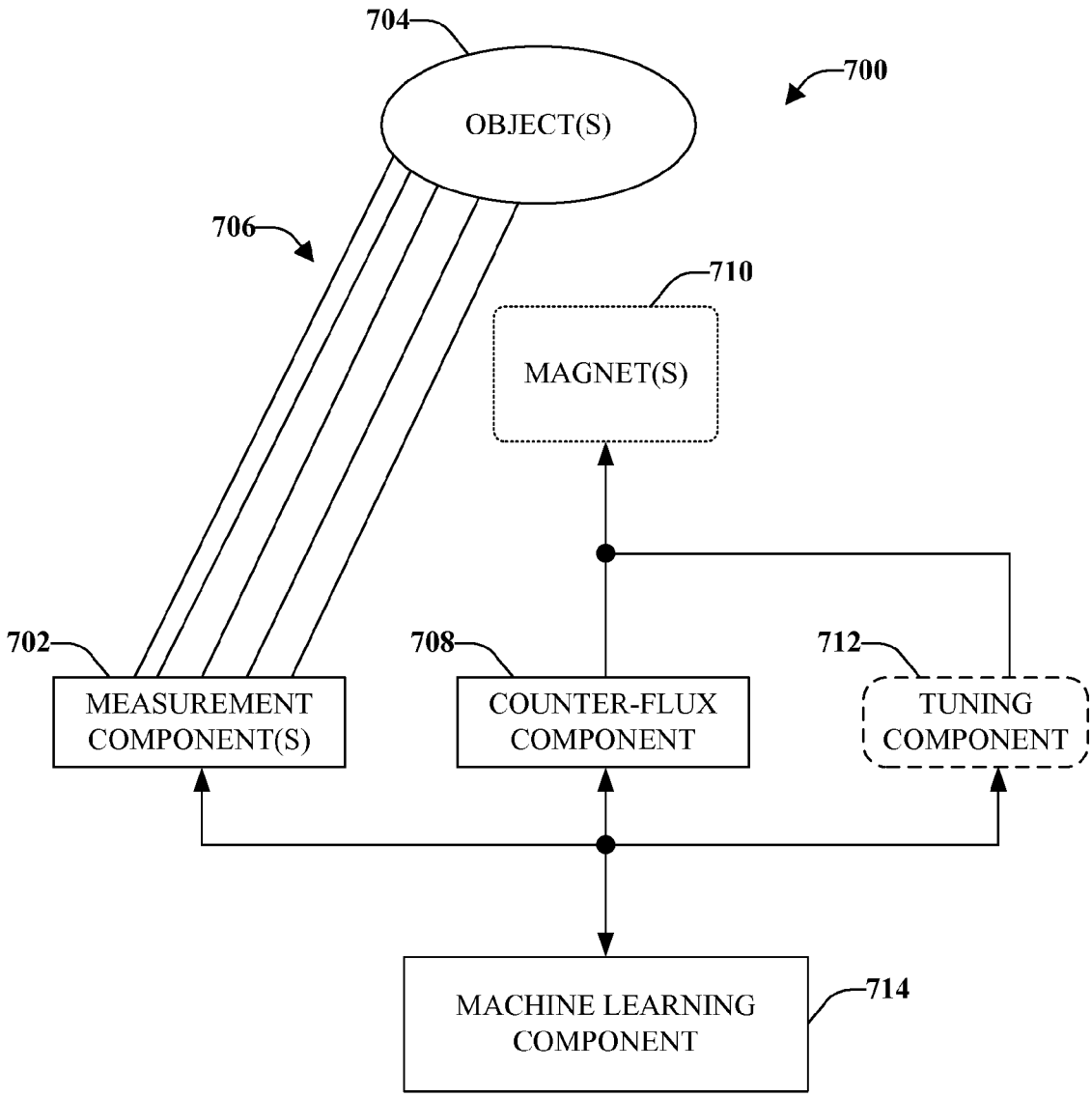
FIG. 7 illustrates a system that employs machine learning which facilitates automating one or more features associated with mitigating an amount of remnant leakage and stray field component values emitted by an object at a certain distance in accordance with the one or more disclosed aspects.

FIG. 7 illustrates a system 700 that employs machine learning which facilitates automating one or more features associated with mitigating an amount of remnant leakage and stray field component values emitted by an object at a certain distance in accordance with the one or more disclosed aspects. System 700 includes one or more measurement components 702 that determines the amount of magnetic flux produced by one or more objects under test 704. A representation of the magnetic flux emitted by the object(s) 704 is illustrated by the lines at 706.

Based in part on the measurement, a counter-flux component 708 determines one or more actions to be taken in an attempt to mitigate the amount of magnetic flux produced. These actions can include determining a number, a size, a polarity, a location, or combinations thereof, of one or more magnets/magnet arrays/geometrical arrangement of magnet arrays. Further, counter-flux component 708 can determine that steel "keepers", magnetic shielding, and/or other techniques to mitigate the amount of remnant leakage and stray field component values should be utilized.

As illustrated, the one or more magnets or magnet arrays 710, should be placed at a proper location around the objects 704 (e.g., within a shipping container) to mitigate the amount of remnant leakage and stray field component values that can be gathered by measurement component(s) 702. It should be noted, that although not illustrated as such, the magnet(s) 710 should be placed in orientation with the magnetic flux field, 706, to provide the desired counter-flux.

In accordance with some aspects, an optional tuning component 712 can be utilized to selectively tune or modify one or more parameters of a counter-flux array 710 to further customize the flux reduction techniques. The tuning or customization recommendation can be communicated to counter-flux component 708 and/or directly applied to the magnet(s) 710 (e.g., automatically, manually through interaction with a user or operator, and so forth).

After modifications are applied, a second measurement can be gathered by the measurement component(s) 702 and, if needed, further flux reduction techniques can be recommended by counter-flux component 708 and selectivity modified by tuning component 712, if available. It should be appreciated that this feedback loop can be utilized any number of times depending on the amount of customization desired as well as other considerations.

In an optional aspect, system 700 includes a machine learning component 714 (e.g., artificial intelligence, rules based logic, and so forth) that can be associated with system 700 (e.g., in connection with determining an amount of counter-flux to apply) for carrying out various aspects thereof. For example, a process for determining if an object under test 704 produces a flux measurement that is at or above a threshold level at a certain distance can be facilitated through an automatic classifier system and process.

Artificial intelligence based systems (e.g., explicitly and/or implicitly trained classifiers) can be employed in connection with performing inference and/or probabilistic determinations and/or statistical-based determinations as in accordance with one or more aspects as described herein. As used herein, the term "inference" refers generally to the process of reasoning about or inferring states of the system, environment, and/or user from a set of observations as captured through events, sensors, and/or data. Inference can be employed to identify a specific context or action, or can generate a probability distribution over states, for example. The inference can be probabilistic—that is, the computation of a probability distribution over states of interest based on a consideration of data and events. Inference can also refer to techniques employed for composing higher-level events from a set of events and/or data. Such inference results in the construction of new events or actions from a set of observed events and/or stored event data, whether or not the events are correlated in close temporal proximity, and whether the events and data come from one or several event and data sources. Various classification schemes and/or systems (e.g., support vector machines, neural networks, expert systems, Bayesian belief networks, fuzzy logic, data fusion engines . . . ) can be employed in connection with performing automatic and/or inferred action in connection with the disclosed aspects.

For example, a process for determining the number, size, polarity, location, or combinations thereof, of one or more magnets, magnet arrays, and/or a geometrical arrangement of magnet arrays to mitigate the amount of remnant leakage and stray field component values emitted by one or more objects under test 704 can be facilitated through an automatic classifier system and process. Moreover, where multiple techniques for mitigating the amount of magnetic flux can be utilized (e.g., steel keepers, tuning mechanism, magnetic shielding, custom magnet configurations, directional characteristics), the classifier can be employed to determine which technique (or combination of techniques) to employ in a particular situation.

A classifier is a function that maps an input attribute vector, x=(x1, x2, x3, x4, xn), to a confidence that the input belongs to a class, that is, f(x)=confidence(class). Such classification can employ a probabilistic and/or statistical-based analysis (e.g., factoring into the analysis utilities and costs) to prognose or infer an action that a user desires to be automatically performed.

A support vector machine (SVM) is an example of a classifier that can be employed. The SVM operates by finding a hypersurface in the space of possible inputs, which hypersurface attempts to split the triggering criteria from the non-triggering events. Intuitively, this makes the classification correct for testing data that is near, but not identical to training data. Other directed and undirected model classification approaches include, for example, naïve Bayes, Bayesian networks, decision trees, neural networks, fuzzy logic models, and probabilistic classification models providing different patterns of independence can be employed. Classification as used herein also is inclusive of statistical regression that is utilized to develop models of priority.

As will be readily appreciated, the one or more aspects can employ classifiers that are explicitly trained (e.g., through a generic training data) as well as implicitly trained (e.g., by observing user behavior, receiving extrinsic information). For example, SVM's are configured through a learning or training phase within a classifier constructor and feature selection module. Thus, the classifier(s) can be used to automatically learn and perform a number of functions, including but not limited to determining according to a predetermined criteria the number, size, and/or polarity of magnets to utilize. The criteria can include, but is not limited to, the number of units that are to the shipped at substantially the same time and arrangement of the units for shipment.

Figure 8:
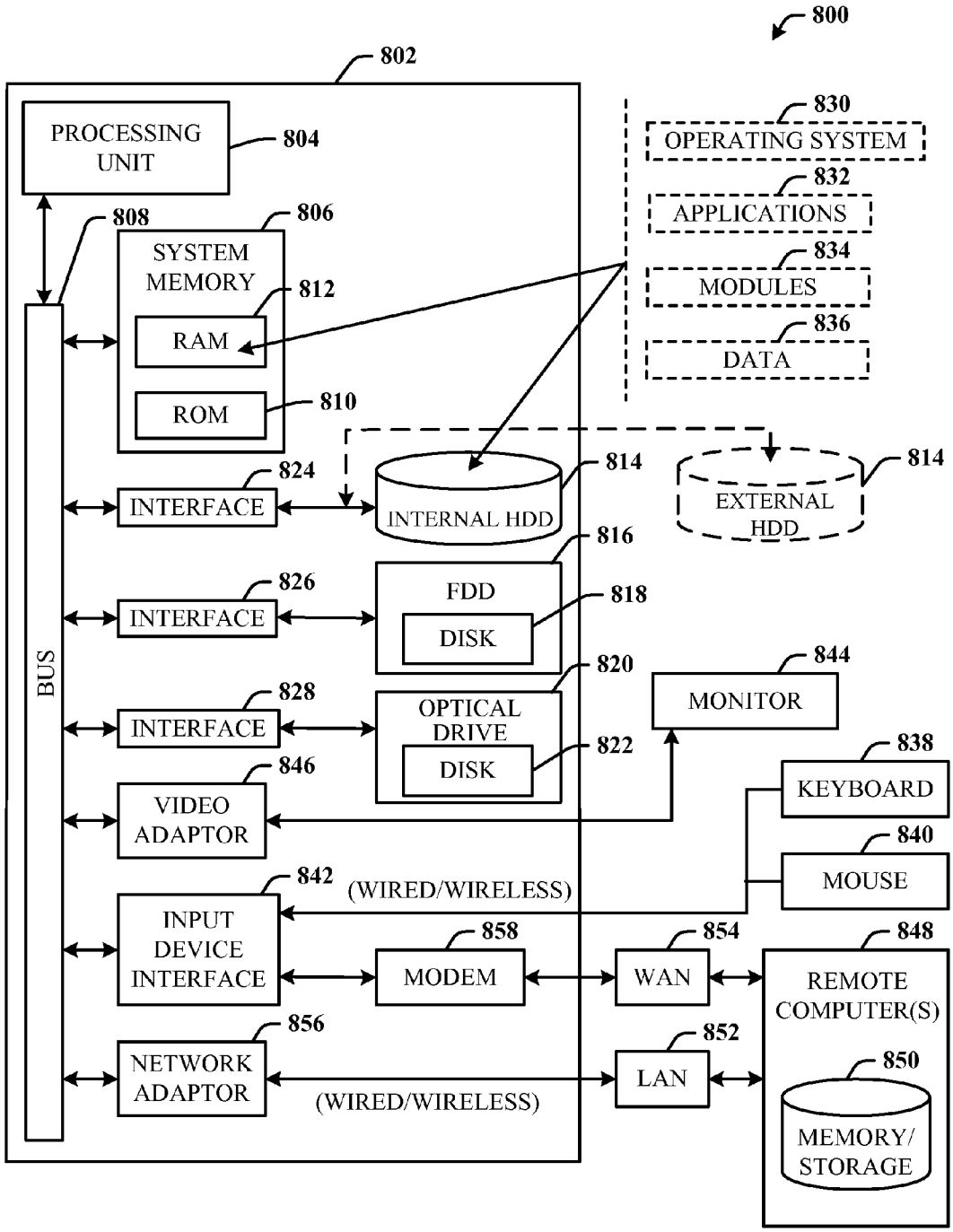
FIG. 8 illustrates a block diagram of a computer operable to execute the disclosed aspects.

Referring now to FIG. 8, illustrated is a block diagram of a computer operable to execute the disclosed aspects. In order to provide additional context for various aspects disclosed herein, FIG. 8 and the following discussion are intended to provide a brief, general description of a suitable computing environment 800 in which the various aspects can be implemented. While the one or more aspects have been described above in the general context of computer-executable instructions that may run on one or more computers, those skilled in the art will recognize that the various aspects also can be implemented in combination with other program modules and/or as a combination of hardware and software.

Generally, program modules include routines, programs, components, data structures, etc., that perform particular tasks or implement particular abstract data types. Moreover, those skilled in the art will appreciate that the inventive methods can be practiced with other computer system configurations, including single-processor or multiprocessor computer systems, minicomputers, mainframe computers, as well as personal computers, hand-held computing devices, microprocessor-based or programmable consumer electronics, and the like, each of which can be operatively coupled to one or more associated devices.

The illustrated aspects may also be practiced in distributed computing environments where certain tasks are performed by remote processing devices that are linked through a communications network. In a distributed computing environment, program modules can be located in both local and remote memory storage devices.

A computer typically includes a variety of computer-readable media. Computer-readable media can be any available media that can be accessed by the computer and includes both volatile and nonvolatile media, removable and non-removable media. By way of example, and not limitation, computer-readable media can comprise computer storage media and communication media. Computer storage media includes both volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital video disk (DVD) or other optical disk storage, magnetic cassettes, magnetic tape, magnetic disk storage or other magnetic storage devices, or any other medium which can be used to store the desired information and which can be accessed by the computer.

Communication media typically embodies computer-readable instructions, data structures, program modules or other data in a modulated data signal such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

With reference again to FIG. 8, the exemplary environment 800 for implementing various aspects includes a computer 802, the computer 802 including a processing unit 804, a system memory 806 and a system bus 808. The system bus 808 couples system components including, but not limited to, the system memory 806 to the processing unit 804. The processing unit 804 can be any of various commercially available processors. Dual microprocessors and other multi-processor architectures may also be employed as the processing unit 804.

The system bus 808 can be any of several types of bus structure that may further interconnect to a memory bus (with or without a memory controller), a peripheral bus, and a local bus using any of a variety of commercially available bus architectures. The system memory 806 includes read-only memory (ROM) 810 and random access memory (RAM) 812. A basic input/output system (BIOS) is stored in a non-volatile memory 810 such as ROM, EPROM, EEPROM, which BIOS contains the basic routines that help to transfer information between elements within the computer 802, such as during start-up. The RAM 812 can also include a high-speed RAM such as static RAM for caching data.

The computer 802 further includes an internal hard disk drive (HDD) 814 (e.g., EIDE, SATA), which internal hard disk drive 814 may also be configured for external use in a suitable chassis (not shown), a magnetic floppy disk drive (FDD) 816, (e.g., to read from or write to a removable diskette 818) and an optical disk drive 820, (e.g., reading a CD-ROM disk 822 or, to read from or write to other high capacity optical media such as the DVD). The hard disk drive 814, magnetic disk drive 816 and optical disk drive 820 can be connected to the system bus 808 by a hard disk drive interface 824, a magnetic disk drive interface 826 and an optical drive interface 828, respectively. The interface 824 for external drive implementations includes at least one or both of Universal Serial Bus (USB) and IEEE 1394 interface technologies. Other external drive connection technologies are within contemplation of the one or more aspects.

The drives and their associated computer-readable media provide nonvolatile storage of data, data structures, computer-executable instructions, and so forth. For the computer 802, the drives and media accommodate the storage of any data in a suitable digital format. Although the description of computer-readable media above refers to a HDD, a removable magnetic diskette, and a removable optical media such as a CD or DVD, it should be appreciated by those skilled in the art that other types of media which are readable by a computer, such as zip drives, magnetic cassettes, flash memory cards, cartridges, and the like, may also be used in the exemplary operating environment, and further, that any such media may contain computer-executable instructions for performing the methods disclosed herein.

A number of program modules can be stored in the drives and RAM 812, including an operating system 830, one or more application programs 832, other program modules 834 and program data 836. All or portions of the operating system, applications, modules, and/or data can also be cached in the RAM 812. It is appreciated that the various aspects can be implemented with various commercially available operating systems or combinations of operating systems.

A user can enter commands and information into the computer 802 through one or more wired/wireless input devices, e.g., a keyboard 838 and a pointing device, such as a mouse 840. Other input devices (not shown) may include a microphone, an IR remote control, a joystick, a game pad, a stylus pen, touch screen, or the like. These and other input devices are often connected to the processing unit 804 through an input device interface 842 that is coupled to the system bus 808, but can be connected by other interfaces, such as a parallel port, an IEEE 1394 serial port, a game port, a USB port, an IR interface, etc.

A monitor 844 or other type of display device is also connected to the system bus 808 through an interface, such as a video adapter 846. In addition to the monitor 844, a computer typically includes other peripheral output devices (not shown), such as speakers, printers, etc.

The computer 802 may operate in a networked environment using logical connections through wired and/or wireless communications to one or more remote computers, such as a remote computer(s) 848. The remote computer(s) 848 can be a workstation, a server computer, a router, a personal computer, portable computer, microprocessor-based entertainment appliance, a peer device or other common network node, and typically includes many or all of the elements described relative to the computer 802, although, for purposes of brevity, only a memory/storage device 850 is illustrated. The logical connections depicted include wired/wireless connectivity to a local area network (LAN) 852 and/or larger networks, e.g., a wide area network (WAN) 854. Such LAN and WAN networking environments are commonplace in offices and companies, and facilitate enterprise-wide computer networks, such as intranets, all of which may connect to a global communications network, e.g., the Internet.

When used in a LAN networking environment, the computer 802 is connected to the local network 852 through a wired and/or wireless communication network interface or adapter 856. The adaptor 856 may facilitate wired or wireless communication to the LAN 852, which may also include a wireless access point disposed thereon for communicating with the wireless adaptor 856.

When used in a WAN networking environment, the computer 802 can include a modem 858, or is connected to a communications server on the WAN 854, or has other means for establishing communications over the WAN 854, such as by way of the Internet. The modem 858, which can be internal or external and a wired or wireless device, is connected to the system bus 808 through the serial port interface 842. In a networked environment, program modules depicted relative to the computer 802, or portions thereof, can be stored in the remote memory/storage device 850. It will be appreciated that the network connections shown are exemplary and other means of establishing a communications link between the computers can be used.

The computer 802 is operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand), and telephone. This includes at least Wi-Fi and Bluetooth™ wireless technologies. Thus, the communication can be a predefined structure as with a conventional network or simply an ad hoc communication between at least two devices.

Wi-Fi, or Wireless Fidelity, allows connection to the Internet from home, in a hotel room, or at work, without wires. Wi-Fi is a wireless technology similar to that used in a cell phone that enables such devices, e.g., computers, to send and receive data indoors and out; anywhere within the range of a base station. Wi-Fi networks use radio technologies called IEEE 802.11(a, b, g, etc.) to provide secure, reliable, fast wireless connectivity. A Wi-Fi network can be used to connect computers to each other, to the Internet, and to wired networks (which use IEEE 802.3 or Ethernet). Wi-Fi networks operate in the unlicensed 2.4 and 5 GHz radio bands, at an 11 Mbps (802.11a) or 54 Mbps (802.11b) data rate, for example, or with products that contain both bands (dual band), so the networks can provide real-world performance similar to the basic 10BaseT wired Ethernet networks used in many offices.

Figure 9:
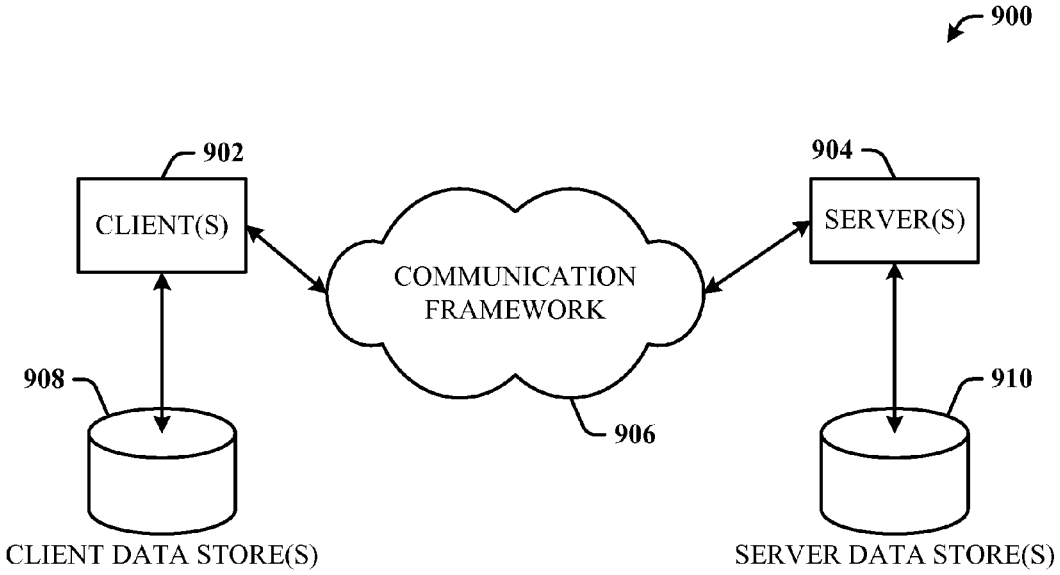
FIG. 9 illustrates a schematic block diagram of an exemplary computing environment in accordance with the various aspects.

Referring now to FIG. 9, illustrated is a schematic block diagram of an exemplary computing environment 900 in accordance with the various aspects. The system 900 includes one or more client(s) 902. The client(s) 902 can be hardware and/or software (e.g., threads, processes, computing devices). The client(s) 902 can house cookie(s) and/or associated contextual information by employing the various aspects, for example.

The system 900 also includes one or more server(s) 904. The server(s) 904 can also be hardware and/or software (e.g., threads, processes, computing devices). The servers 904 can house threads to perform transformations by employing the various aspects, for example. One possible communication between a client 902 and a server 904 can be in the form of a data packet adapted to be transmitted between two or more computer processes. The data packet may include a cookie and/or associated contextual information, for example. The system 900 includes a communication framework 906 (e.g., a global communication network such as the Internet) that can be employed to facilitate communications between the client (s) 902 and the server(s) 904.

Communications can be facilitated through a wired (including optical fiber) and/or wireless technology. The client (s) 902 are operatively connected to one or more client data store(s) 908 that can be employed to store information local to the client(s) 902 (e.g., cookie(s) and/or associated contextual information). Similarly, the server(s) 904 are operatively connected to one or more server data store(s) 910 that can be employed to store information local to the servers 904.

Moreover, it is also noted that the term industrial controller as used herein includes both programmable logic controllers (PLCs) and process controllers from distributed control systems (DCSs), and can include functionality that can be shared across multiple components, systems, and/or networks. One or more industrial controllers can communicate and cooperate with various network devices across a network. This can include substantially any type of control, communications module, computer, I/O device, and/or Human Machine Interface (HMI) that communicates via the network—the network can include control, automated, and/or a public network(s). The industrial controller can also communicate with and control various other devices and/or I/O modules including analog I/O modules, digital I/O modules, programmed/intelligent I/O modules, other programmable controllers, communications modules, and the like. The network (not shown) can include public networks such as the Internet, intranets, and automation networks such as Control and Information Protocol (CIP) networks including DeviceNet and ControlNet. Further, the network can include Ethernet, DH/DH+, Remote I/O, Fieldbus, Modbus, Profibus, wireless networks, serial protocols, and so forth. In addition, the network devices can include various hardware and/or software components such as switches having virtual local area network (VLAN) capability, local area networks (LANs), wide area networks (WANs), proxies, gateways, routers, firewalls, virtual private network (VPN) devices, servers, clients, computers, configuration tools, monitoring tools, and/or other devices.

What has been described above includes examples of the various aspects. It is, of course, not possible to describe every conceivable combination of components or methodologies for purposes of describing the various aspects, but one of ordinary skill in the art may recognize that many further combinations and permutations are possible. Accordingly, the subject specification intended to embrace all such alterations, modifications, and variations.

In particular and in regard to the various functions performed by the above described components, devices, circuits, systems and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects. In this regard, it will also be recognized that the various aspects include a system as well as a computer-readable medium having computer-executable instructions for performing the acts and/or events of the various methods.

In addition, while a particular feature may have been disclosed with respect to only one of several implementations, such feature may be combined with one or more other features of the other implementations as may be desired and advantageous for any given or particular application. To the extent that the terms "includes," and "including" and variants thereof are used in either the detailed description or the claims, these terms are intended to be inclusive in a manner similar to the term "comprising." The term "or" as used in either the detailed description of the claims is meant to be a "non-exclusive or".

The word "exemplary" as used herein to mean serving as an example, instance, or illustration. Any aspect or design described herein as "exemplary" is not necessarily to be construed as preferred or advantageous over other aspects or designs.

Furthermore, the one or more aspects may be implemented as a method, apparatus, or article of manufacture using standard programming and/or engineering techniques to produce software, firmware, hardware, or any combination thereof to control a computer to implement the disclosed aspects. The term "article of manufacture" (or alternatively, "computer program product") as used herein is intended to encompass a computer program accessible from any computer-readable device, carrier, or media. For example, computer readable media can include but are not limited to magnetic storage devices (e.g., hard disk, floppy disk, magnetic strips . . . ), optical disks (e.g., compact disk (CD), digital versatile disk (DVD) . . . smart cards, and flash memory devices (e.g., card, stick). Additionally it should be appreciated that a carrier wave can be employed to carry computer-readable electronic data such as those used in transmitting and receiving electronic mail or in accessing a network such as the Internet or a local area network (LAN). Of course, those skilled in the art will recognize many modifications may be made to this configuration without departing from the scope of the disclosed aspects.

What is claimed is:

1. A method for mitigating an amount of a measured flux field, comprising: measuring a magnetic flux field of one or more units at a specified distance from the one or more units yielding a measured magnetic flux field; and specifying, as a function of the measured magnetic flux field, a magnet array having a counter-flux estimated to maintain the magnetic flux field of the one or more units at the specified distance from the one or more units at or below a defined level; remeasuring the magnetic flux field via a feedback loop yielding a new measured magnetic flux field; and adjusting at least one of a strength of a magnet in the magnet array, a number of magnets in the magnet array, a polarity of the magnet in the magnet array, or a location of the magnet in the magnetic array based on the new measured magnetic flux field to maintain a horizontal magnetic field at or below the defined level at the specified distance from the one or more units.

2. The method of claim 1, wherein the specifying includes recommending at least one of a size of a magnet in the magnet array, a number of magnets in the magnet array, a polarity of the one or more magnets, or a location of the one or more magnets relative to the one or more units.

3. The method of claim 1, wherein the specifying includes recommending placing a B-Field vector of the magnet array orthogonal to a direction of the magnetic flux field.

4. The method of claim 1, wherein the specifying includes specifying one or more magnetic tiles that provide a return path for leakage stray fields measured by the measuring.

5. The method of claim 1, wherein the specifying includes specifying one or more steel keepers to capture stray flux at a magnetic emanation point.

6. The method of claim 1, wherein the specifying includes specifying magnetic shielding with the magnet array.

7. The method of claim 6, wherein the specifying the magnetic shielding includes specifying magnetic shielding having a multi-layered configuration of high permeability steel and medium permeability steel, wherein at least two layers of the multi-layered configuration are separated by non-magnetic material or paramagnetic material.

8. The method of claim 1, further comprising:

identifying a polarity of a magnetic field direction of the one or more units based on the measuring; and specifying a relative orientation of the one or more units, calculated to reduce the magnetic flux field, as a function of the at least the polarity.

9. The method of claim 8, wherein the specifying the relative orientation comprises specifying at least one of a side-by-side orientation, a stacked orientation, or an angular placement orientation.

10. A system for mitigation of a horizontal magnetic field, comprising: a measurement component configured to collect first information relating to an amount of a horizontal magnetic field and a direction of the horizontal magnetic field measured at a given distance from one or more objects that produce the horizontal magnetic field; a counter-flux component configured to generate, as a function of the first information, a recommendation of a magnet array for orientation around the one or more objects, wherein the magnetic array is estimated to produce a counter-flux that reduces the horizontal magnetic field at the given distance from the one or more objects below a defined level; and a tuning component, incorporated in a feedback loop between the counter-flux component and the one or more objects, configured to alter at least one of a magnet strength, a number of magnets, a magnet polarity, or a location of the magnet array to maintain the horizontal magnetic field at the given distance from the one or more objects below the defined level based on second information, collected by the measurement component, relating to the amount of the horizontal magnetic field and the direction of the horizontal magnetic field measured at the given distance from the one or more objects.

11. The system of claim 10, wherein the measurement component is configured to determine a polarity of the horizontal magnetic field, and the counter-flux component configured to recommend an orientation of the one or more objects with respect to one another, the orientation calculated to reduce the horizontal magnetic field.

12. The system of claim 11, wherein the orientation comprises at least one of a side-by-side orientation, a stacked orientation, or an angular placement orientation.

13. The system of claim 10, wherein the counter-flux component is configured to generate the recommendation such that a B-Field vector of the magnet array is substantially orthogonal to the direction of the horizontal magnetic field.

14. The system of claim 10, wherein the counter-flux component is configured to selectively recommend at least one of a steel keeper or magnetic shielding in addition to the magnet array.

15. The system of claim 10, wherein the tuning component is configured to alter the at least one of the magnet strength, the number of magnets, the magnet polarity, or the location of the magnet array at least one of a mechanically or electromagnetically.

* * * * *